United States Patent [19]

Emadi et al.

[11] Patent Number: 4,929,184

[45] Date of Patent: May 29, 1990

[54] KEYED ELECTRICAL CONNECTORS WITH JACKSCREWS

[75] Inventors: Atahusain E. Emadi, Carlisle; Eric T. Green, Hummelstown; John S. Margosiak, Middletown; Daniel J. Mignogna, Harrisburg; Dennis E. Smith, Elizabethtown, all of Pa.

[73] Assignee: AMP Incorporated, Harrisburg, Pa.

[21] Appl. No.: 400,640

[22] Filed: Aug. 30, 1989

Related U.S. Application Data

[63] Continuation-in-part of Ser. No. 362,736, Jun. 7, 1989, Pat. No. 4,895,535.

[51] Int. Cl.[5] ..... H01R 13/645

[52] U.S. Cl. ..... 439/681; 439/362

[58] Field of Search ..... 439/292, 345, 359, 362, 439/367, 677, 607, 680, 681

[56] References Cited

U.S. PATENT DOCUMENTS

| | | | |
|---|---|---|---|
| 2,746,022 | 5/1956 | Gilbert | 339/92 |
| 2,902,665 | 9/1959 | D'Amico | 339/184 |
| 3,030,602 | 4/1962 | Jackson et al. | 339/92 |
| 3,112,974 | 12/1963 | Curtis et al. | 339/49 |
| 3,177,461 | 4/1965 | Hagan et al. | 339/184 |
| 3,426,315 | 2/1969 | De Tar | 339/105 |
| 3,491,330 | 1/1970 | Barnhart et al. | 339/184 |
| 3,555,491 | 1/1971 | Moss | 339/92 |
| 3,573,677 | 4/1971 | Detar | 333/79 |
| 3,582,867 | 6/1971 | Thompson et al. | 339/92 |
| 3,594,698 | 7/1971 | Anhalt | 339/75 M |
| 3,853,381 | 12/1974 | Morningstar | 339/92 M |
| 4,109,987 | 8/1978 | Bourdon | 339/75 M |
| 4,159,862 | 7/1979 | Funck et al. | 339/186 M |
| 4,181,391 | 1/1980 | Kilsdonk | 339/92 M |
| 4,277,126 | 7/1981 | Lincoln | 339/186 M |
| 4,367,003 | 1/1983 | Frantz | 339/91 R |
| 4,460,230 | 7/1984 | McKee et al. | 339/106 |
| 4,519,667 | 5/1985 | Canning et al. | 339/186 M |
| 4,715,829 | 12/1987 | Preputnick | 439/660 |
| 4,778,411 | 10/1988 | Rudy, Jr. et al. | 439/681 |

FOREIGN PATENT DOCUMENTS

| | | |
|---|---|---|
| 961714 | 6/1964 | United Kingdom . |
| 1089073 | 11/1967 | United Kingdom . |

OTHER PUBLICATIONS

AMP Catalog 81-655 Revised 3-86; "AMP-HDI 2--Piece Pc Board Connectors," pp. 39-40; AMP Incorporated, Harrisburg, Pa.

AMP Catalog 79-547 (Revised 8-88); "Subminiature D Pin and Socker Connectors per MIL-C-24380 (AMPLIMITE);" pp. 2-5, 19, 37-38; AMP Incorporated, Harrisburg, Pa.

*Primary Examiner*—Eugene F. Desmond
*Assistant Examiner*—Walter G. Hanchuk
*Attorney, Agent, or Firm*—Anton P. Ness

[57] ABSTRACT

A system of keying and fastening together a pair of mating connectors is provided where each of the connectors is of the type having forward and rearward thin walled metal shells clinched together about their flanged edges to retain a housing means therewithin, with the forward and rearward shells having adjacent aperture lateral flanges. The system includes a pair of key members each securable to the front of the forward shell at a respective lateral flange, seated within correspondingly hexagonally shaped flange apertures of the forward shell only, held against the front surface of the rearward shell. On one of the connectors a pair of jackscrews extend through the flange apertures and through with the apertures being slightly larger than the jackscrew portions extending therethrough, the jackscrews being apertures of the key members of the one connector, secured rearwardly of the connector by means permitting rotation after mounting and simultaneously securing the key members to the connector. The key members of the other connector have threaded apertures thereinto from the leading end for being threadedly engaged by the threaded leading ends of the jackscrews of the mating connector, to fasten the connectors together during mating immediately after keying.

15 Claims, 3 Drawing Sheets

KEYED ELECTRICAL CONNECTORS WITH JACKSCREWS

REFERENCE TO RELATED APPLICATION

This application is a Continuation-in-Part of U.S. patent application Ser. No. 07/362,736 filed June 7, 1989 now U.S. Pat. No. 4,895,535.

FIELD OF THE INVENTION

The present invention relates to the field of electrical connectors and more particularly to matable connectors which are matchingly keyed.

BACKGROUND OF THE INVENTION

Certain electrical connectors are to be mated to mating connectors with mating arrays of terminals thereof to become electrically engaged along connector mating faces. Where a plurality of similar such connectors are located adjacent each other in an array, for mating to a like plurality of mating connectors, the connectors must be labeled or otherwise visibly marked to indicate which of the mating connectors all similar in appearance and shape, are to mate with which of the mounted connectors all similar in appearance and shape.

It would be desirable to provide a means to mechanically prevent all but the particular mating connector from being mated to a particular connector. Types of connectors are known in which cooperating keying structures are utilized which are shaped and positioned and correspondingly oriented along the respective mating faces of the pair of connectors to allow mating when the two connectors matchingly keyed are being moved axially together, but abut and physically obstruct mating when two connectors are being moved together which are not matchingly keyed.

Such keys are usually used in pairs matable with corresponding pairs and usually have body sections which are hexagonal (or octagonal) in cross-sectional shape, and the keys of each pair are secured to a respective one of the connectors with their body sections in apertures of the connector housing which are correspondingly shaped in cross-section; thus each key can be secured in its respective aperture in any one of six (or eight) different positions, respectively. Each key includes a keying projection extending axially forwardly from the body section but only extending around one half of the circumference; the corresponding key will have a keying projection which will enter the region comprising the other one half of the circumference, when the two connectors which are matchingly keyed are moved axially together. The opposing keys of two otherwise matable connectors which are not matchingly keyed, will abut at their leading ends prior to at least the mating terminals of the connectors engaging. By coordinating the selection of positions of the two keys of each connector of the pair desired to be matable, the keys provide a means for physically encoding the mating faces of the pair of connectors. Exemplary keys are disclosed in U.S. Pat. Nos. 4,277,126; 3,426,315; 4,159,862; 3,491,330; and 4,778,411.

Certain connectors are also known in which a pair of jackscrews are utilized to hold the connectors together in mated relationship by extending from one connector to a threaded aperture of the other along the mating face, where each jackscrew is rotatable to bring the connector mating faces assuredly together in the last stages of mating. For example, see U.S. Pat. Nos. 3,853,381; 3,573,677 and 3,112,974.

There are prior art connectors in which jackscrew hardware is assembled to the connector in conjunction with keying hardware radially surrounding portions of the jackscrews to economize on space across the mating faces on the connectors, as in U.S. Pat. Nos. 4,181,391; 3,555,491; 4,109,987 and 3,582,867.

In U.S. Pat. No. 3,555,491 polarizing members are disposed in apertures of lateral flanges of molded plastic housings and have three circumferentially spaced polarizing projections extending forwardly of the leading ends of the connector housings. A jackscrew extends through a central passageway of each member of one of the connectors and has a threaded forward shank end extending forwardly of the polarizing projections. The opposing member includes a threaded insert axially rearwardly of the projections to be threadedly engaged by the threaded jackscrew end during fastening after connector keying. Threaded engagement between the jackscrew and the insert occurs after the polarizing projections of the polarizing members have moved past each other along most of their lengths. The reference also discloses a mechanism for preventing overtorque during turning of the jackscrew, by allowing rotation of the threaded insert after a certain torque level has been reached as the connectors are completely mated. Other prior art discloses using jackscrews with polarizing hardware or assembled to serve a polarizing function include U.S. Pat. Nos. 2,902,665 and 2,746,022.

In U.S. Pat. No. 4,181,391 a connector mounted to a printed circuit board includes a key member which includes a threaded aperture rearward of the keying projection and is adapted to be threadedly engaged by a correspondingly threaded forward shank end of the jackscrew extending from a corresponding key of the mating, matchingly keyed connector. If the mating connectors were not matchingly keyed, the opposing keying projection forward ends would abut, the connectors would not mate, and the forward jackscrew end would not enter the threaded key aperture to fasten the connectors together.

In one type of connector and matable connector, one of them includes a forward plug section of the terminal housing which is D-shaped in transverse cross-section to be received in a cavity of the other upon mating, with the cavity being correspondingly D-shaped. Each of the housings is secured within metal front and rear shell members each of which is stamped and drawn or stamped and formed, defining a central housing-receiving cavity within which the dielectric housing is placed, after which the shells are secured to each other thus holding the housing therewithin. The front and rear shells include flanges extending transversely outwardly from the housing-receiving cavity to abut a transverse surface of the panel to which the panel-mountable connector is to be mounted, surrounding the panel cutout, and including a pair of lateral flange sections including apertures through which extend mounting fasteners such as mounting screws to hold the connector to the panel. The front shell of one of the matable pair of connectors includes a forwardly extending hood section which comprises the D-shaped plug-receiving cavity; the front shell of the other connector also has a D-shaped forwardly extending section slightly smaller to be receivable into the cavity, and which contains the housing's plug section.

One such pair of connectors is a product sold by AMP Incorporated under Part Nos. 208743-1 and 208552-1. In the AMP product the front and rear shells are secured together by a pair of small tabs extending outwardly from the edge of each lateral flange section of one of the shells being bent around the corresponding flange section of the other shell so that the shell members are clinched together at each end. U.S. Pat. No. 4,895,535 discloses such connectors which are keyed by hermaphroditic keys, and in which one of the connectors is mounted to a panel and the connectors retain their mated relationship without jackscrews or other fastener mechanisms.

It is desired to provide keying for a mating pair of connectors where the keying is adapted to be utilized with jackscrew fastener mechanisms, where it is desired that such connectors be assuredly held together by hardware, in a manner which minimizes the amount of mating face real estate occupied by the total of the keying and fastener hardware.

It is also desired to provide a means for assembling the keys and jackscrews easily and in a manner permitting easy disassembly, for facilitating assembly and disassembly at the application site in order for customizing the key orientations and permitting changing the orientations, as well as replacement of parts.

It is further desired to provide jackscrew/keying systems which are defined in a minimum number of separate parts by providing a connector shell assembly modified to facilitate assembly.

SUMMARY OF THE INVENTION

The present invention provides for securing the keys to the connectors away from the contact region of the mating faces thereof, by securing the keys to the lateral flanges defined by the shell assemblies of the connectors, with the shell assemblies comprising forward shell members clinched to rearward shell members. For a pair of hexagonal keys, for example, to provide for thirty-six different keying arrangements, the seating aperture of each flange of each forward shell having a correspondingly hexagonal shape formed into the metal, and the rearward shell includes a circular hole with a smaller diameter, aligned with the seating aperture. Each of the key members includes a body section having the hexagonal cross-sectional shape to be seated in the correspondingly shaped seating aperture which will prevent rotation of the key member after mounting.

One of the key members (termed herein a mounting key) is adapted to receive a jackscrew member mounted therealong, while the other key member (a mating key) is adapted to be threadedly engaged by a forward threaded end of the shank of the jackscrew member upon connector mating, where the connectors are matchingly keyed. The jackscrew member includes a forward shank portion which is threaded, and the keying projection of the mounting key defines a generally semicircular hood which is radially spaced from and coextending forwardly along the jackscrew shank to a leading end forward of the jackscrew forward end; the hood is defined by an inner cylindrical surface coaxial with the jackscrew shank, and an outer surface defined by three adjacent flat surfaces comprising three sides of a hexagon.

The mounting key of the present invention includes a profiled aperture having a larger diameter forward portion within which a larger diameter body section of the jackscrew is seated, and a smaller diameter rearward portion through which extends a smaller diameter jackscrew mounting section, with both of the aperture portions dimensioned to allow the jackscrew to be rotated freely within the mounting key after assembly. The jackscrew includes a rearward shank portion extending rearwardly, and a slotted jackscrew nut is placed thereon, and a roll pin is inserted transversely through aligned small holes to secure the nut on the jackscrew and the jackscrew to the connector in a manner permitting rotation relative to the connector and the mounting key seated therein, with the roll pin being removable to permit disassembly if desired. The hood portion of the forward connector shell extends to a leading end just forwardly of the hood-shaped keying projection leading end, with the mounting key and the jackscrew leading ends thus not extending forwardly of the forwardmost shell portion reducing their exposure for possible damage and misalignment.

The mating key includes a keying projection which is generally a sleeve having a central bore thereinto which is threaded to be engaged by the forward jackscrew end upon connector mating. In cross-section the keying projection extends radially outwardly to three flat side surfaces defining half of a hexagon extending around half of the periphery of the sleeve, while the remainder of the sleeve periphery is defined by a cylindrical surface of an appropriate small diameter thereby defining an axial recess and being adapted to receive therealong the hood-shaped keying projection of the mounting key upon connector mating when the connectors are matchingly keyed, as the jackscrew shank is threadedly received into the central bore upon rotation of the jackscrew. The mating key includes a threaded rearward shank portion extending rearwardly from the connector's rearward shell member for a nut to be threaded thereonto with a lock washer, securing the mating key tightly to the shell assembly in a manner permitting disassembly.

The mating and mounting keys include chamfered surfaces at their leading ends to facilitate the keying projections passing by each other at initial stages of mating which constitutes the keying engagement. The jackscrew leading end also is rounded or tapered to facilitate entry into the threaded aperture of the mating key. The keying and fastening system thus is adapted to allow for slight misalignment of the keys and jackscrews by providing for self-adjustment of the alignment, since the hardware is secured to a pair of thin plate shells having minimal engagement with rearward portions of the keys and jackscrews axially therealong which otherwise would commonly not provide for assured perpendicular alignment thereof.

It is an objective of providing keying for connectors fastenable together with jackscrews, without increasing the lateral dimensions of the shell flanges commonly in use with the prior art connectors, thus not increasing the envelope occupied by the connector assembly, facilitating close connector spacing.

It is also an objective to provide jackscrew/keying systems in which the jackscrew begins threading into the mating fastening hardware as early in the mating procedure as possible which stabilizes the connectors as early in the fastening procedure as possible, while being slightly recessed from the key's leading end to provide a measure of physical protection from damage and misalignment during handling.

It is a further objective to provide jackscrew/keying systems for assemblies of connectors each having forward and rearward shell members together laterally protecting the mating dielectric housing portions, where the jackscrews begin to be threadedly engageable with mating fastening hardware immediately after key members meet to permit connector mating.

It is yet a further objective to provide such systems mounted to thin shell flanges wherein slight angular misalignment of the keys and jackscrews is inherently overcome during connector mating.

It is also a further objective to provide a means for securing the hardware to the connectors easily, permitting on-site key orientation in the context of an array of like connectors, and in a manner permitting easy disassembly if desired for replacement of parts or re-orientation of a key.

An embodiment of the present invention will now be described with reference to the accompanying drawings.

DETAILED DESCRIPTION OF THE PREFERRED EMBODIMENT

Figure 1:
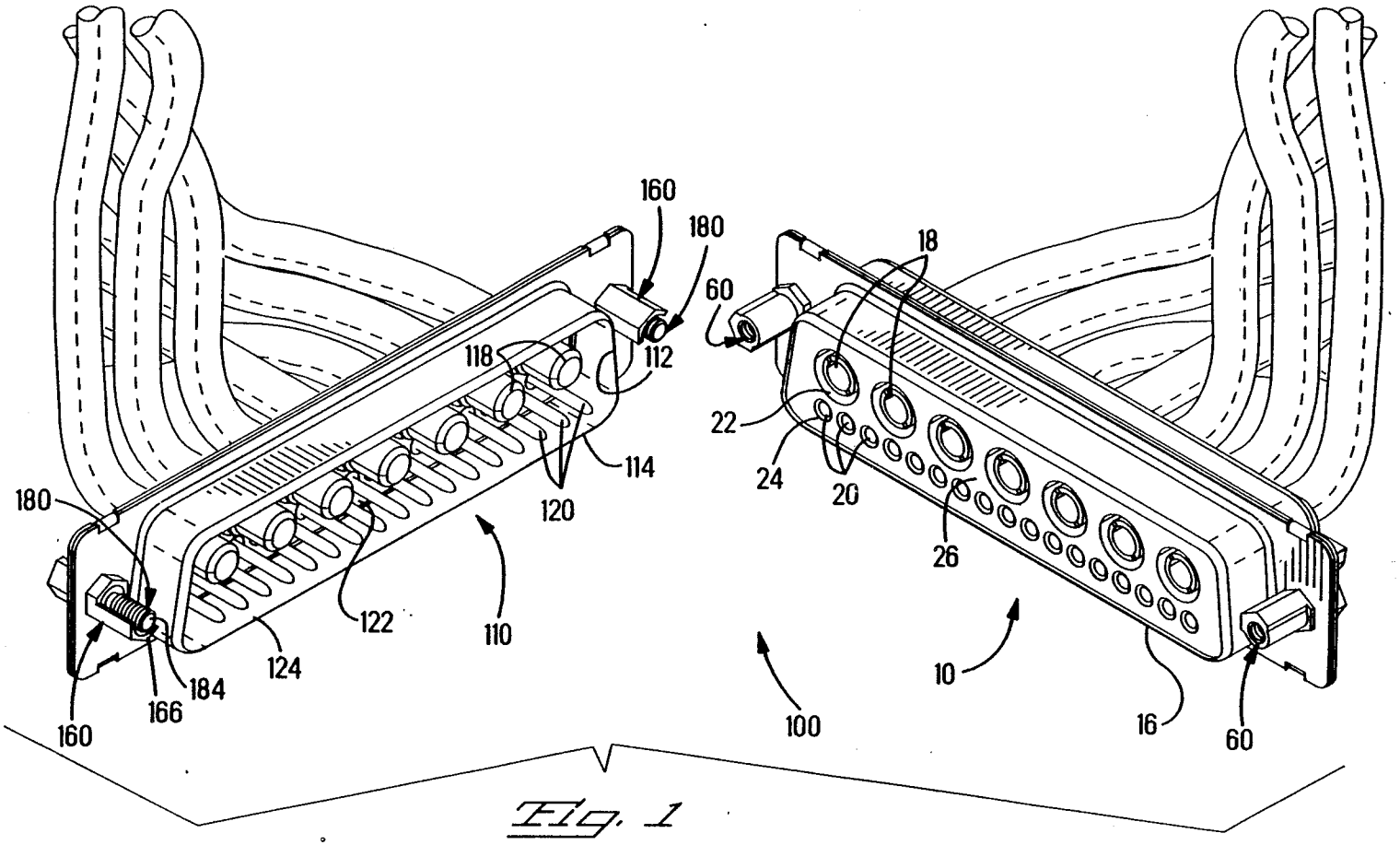
FIG. 1 shows a matable pair of connectors which are matchingly keyed according to the present invention.

A connector assembly 100 comprising a pair of matable electrical connectors 10,110 are shown in FIG. 1 which are matchingly keyed, according to the present invention. Connector 10 has a forward plug section 16 which is receivable into large cavity 112 of hood section 114 of connector 110 upon mating; forward plug section 16 and hood section 114 are correspondingly dimensioned and D-shaped for polarization so that mating of the connectors occurs when both connectors are appropriately oriented with respect to each other, as is known. Forward plug section 16 has a plurality of terminals 18,20 having socket contact sections disposed in passageways 22,24 in communication with mating face 26 of connector 10, while connector 110 has a like plurality of terminals 118,120 having pin contact sections extending forwardly from mating face 122 within hood section 114 which will be received into entrances to passageways 22,24 and into the socket contact sections of terminals 18,20 of connector 10 upon mating.

Figure 2:
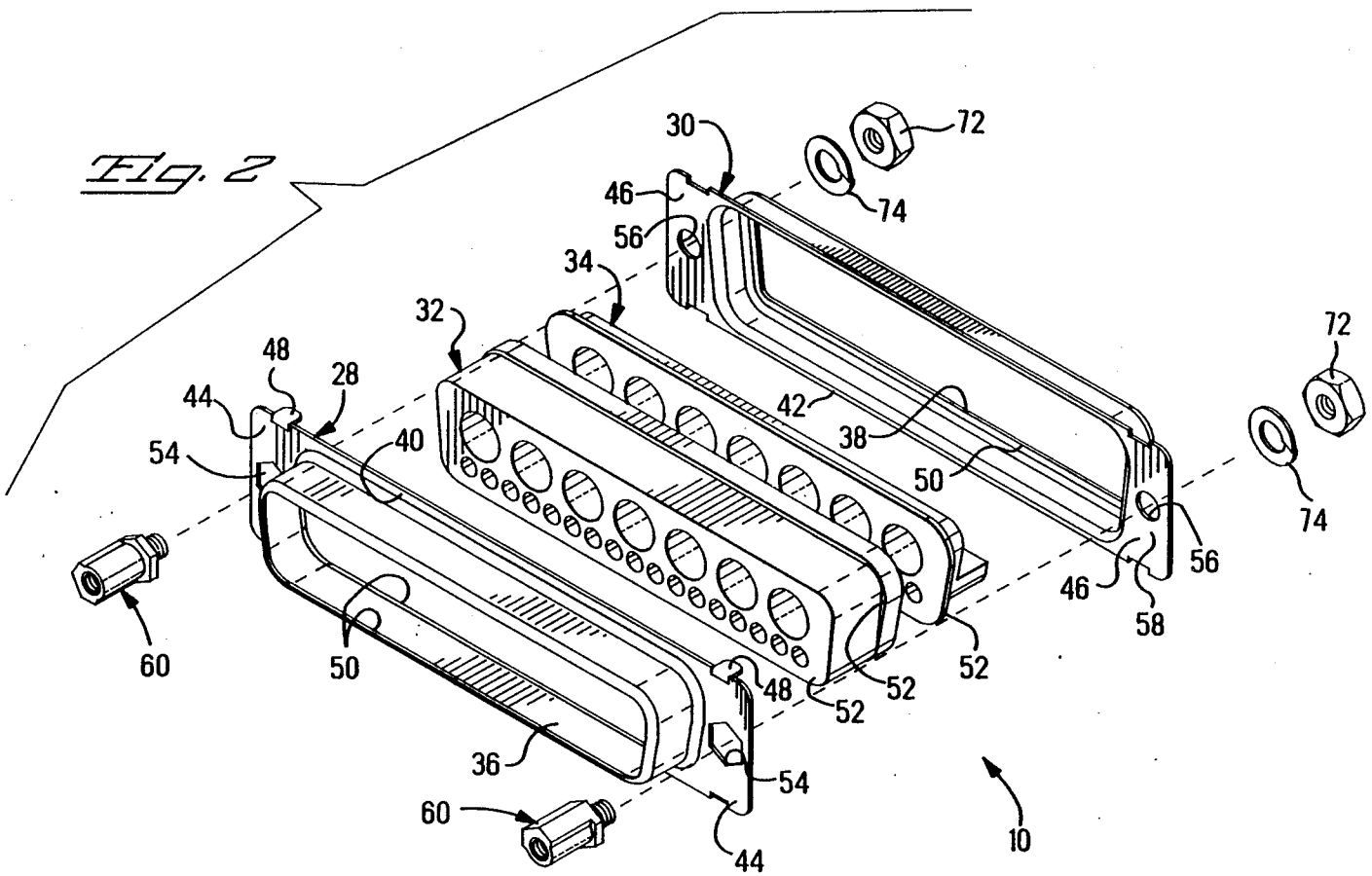
FIG. 2 is an exploded view of one of the connectors of FIG. 1.

Referring to FIG. 2, connector 10 includes a forward shell member 28 and and a rearward shell member 30 which together define a protective shell containing housing inserts 32,34 and terminals 18,20 (FIG. 1). In AMP Part Nos. 208743-1 and 208552-1 shell members 28,30 are stamped and drawn from steel into thin-walled members and then preferably cadmium plated. Shell members 28,30 include respective housing apertures 36,38 extending axially therethrough and transverse peripheral flanges 40,42 surrounding housing apertures 36,38, and extending laterally from opposed ends of the shell members are lateral flanges 44,46. Forward shell member 28 includes a pair of clinching tabs 48 along edges of both lateral flanges 44, which are bent over corresponding edges of rearward shell member 30 to secure the shell members together, with housing inserts 32,34 held therebetween in housing apertures 36,38 by ledge portions 50 of peripheral flanges 40,42 against insert edges 52, as is known in the prior art. Through lateral flanges 44,46 extend holes 54,56 aligned with each other when the shell members are clinched together. Connector 110 of FIG. 1 is similarly constructed, with forward and rearward shell members thereof having apertured lateral flanges.

Figure 3:
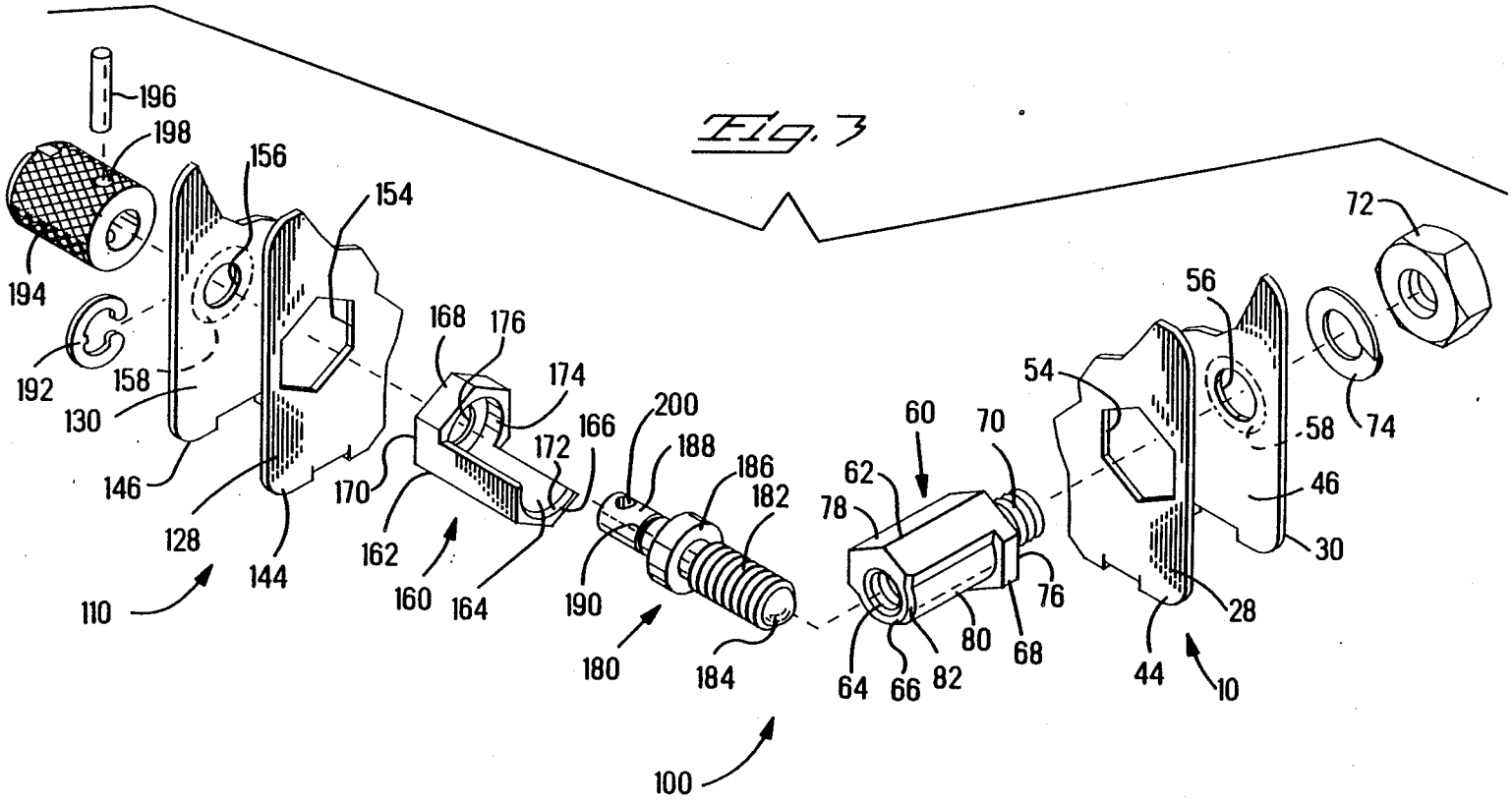
FIG. 3 is an enlarged view of the key and jackscrew members and mounting accessories usable with the present invention.

The keying and jackscrew hardware utilized in the present invention is similar to that disclosed in U.S. patent application Ser. No. 071400,857 filed Aug. 30, 1989 and assigned to the assignee hereof. Referring to FIGS. 1 to 3, key member 60 includes a keying projection 62 having a threaded bore 64 thereinto from leading end 66, a hexagonal body section 68, and a threaded rearward mounting section 70. Mounting section 70 extends through apertures 54,56 and rearwardly of rearward flange surface 46 onto which a nut 72 is secured along with lock washer 74. Aperture 54 forwardly of aperture 56 is shaped to define a seat for key body section 68 in order to hold key 60 against rotation after assembly, in conjunction with forwardly facing surface portion 58 of rearward shell flange 46 surrounding smaller diameter aperture 56 against which is disposed a rearwardly facing surface 76 of key body section 68. The key members and corresponding seating apertures 54 could also have the shape of an octagon or other regular polygon.

Keying projection 62 includes around about a first half 78 of its periphery a series of three adjacent flat side surfaces defining three sides of a hexagon, which may extend forwardly from three sides of the hexagonally cross-sectioned body section 68. The second half of the periphery comprises a semicylindrical surface 80 having a radius smaller than the general cross-sectional dimension of the body section 68, thus defining an axial recess of arcuate shape extending from leading end 66 to body section 68. Leading end 66 is chamfered along the outer edge at 82 adjacent semicylindrical surface 80.

Forward and rearward shell members 128,130 of connector 110 include flanges 144,146 at each end laterally of hood section 114. Flange 144 is similar to flange 44 of shell 28 and includes a hexagonal seating aperture 154 extending therethrough providing for seating of a key member 160 in conjunction with forwardly facing surface portion 158 of rearward shell flange 146 surrounding smaller diameter aperture 156. Key member 160 includes a fully hexagonal body section 168 which is seated in aperture 154 with rearwardly facing surface 170 against flange surface 158, to prohibit key rotation after assembly. The key member further includes a keying projection 162 shaped like an elongate semicylindrical hood having an arcuate inner surface 164 extending forwardly to a leading end 166. Hood-shaped keying projection 162 is adapted to be received along the axial recess defined along semicylindrical surface 78 of keying projection 62 of mounting key 60 during mating of connectors which are matchingly keyed with the mating and mounting keys secured in cooperating keying orientations. Leading end 166 is chamfered at 172 adjacent semicylindrical inner surface 164. Chamfer 172 will cooperate with chamfer 82 during initial stages of connector mating to enable keying projections 62,162 of key members 60,160 to pass by each other where they are matchingly oriented to permit keying but may be slightly angularly misaligned.

Jackscrew 180 is assembled to connector 110 along with key 160 and defines the means for securing key 160 to the connector. Jackscrew 180 includes a forward shank 182 extending to a leading end 184 and is threaded therealong to correspond with threaded bore 64 of key 60 of mating connector 10. Rearwardly from forward shank 182 is a large diameter seating section 186, and rearwardly therefrom extends a smaller diameter mounting section 188. Body section 168 of key 160 includes a large diameter hole 174 corresponding to jackscrew seating section 186, and further includes a smaller diameter hole portion 176 rearwardly thereof concentric therewith, so that jackscrew 180 is inserted through key 160 for assembly with jackscrew seating section 186 seated within hole portion 174 and mounting section 188 extending rearwardly through hole portion 176 from body section 168 of key 160 and through circular aperture 156 of flange 146 of rearward shell member 130. Mounting section 188 includes an annular recess 190 which will be exposed rearwardly of shell flange 146 upon assembly, into which a C-shaped locking ring 192 is snapped to proVide a temporary means for holding jackscrew 180 and perforce mounting key member 160 to clinched shell members 128,130 during assembly, facilitating assembly of the keying and jackscrew hardware.

A jackscrew nut 194 is then mounted to the rearwardly extending jackscrew mounting section 188 by means of a roll pin 196 inserted in an interference fit transversely through pin-receiving hole 198 of nut 194 and through pin-receiving hole 200 through jackscrew mounting section 188 aligned with hole 198. Roll pin 194 is easily removed by simple tools if desired for replacement of parts or re-orientation of key member 160. Nut 194 is slotted for example to be rotated by a tool such as a screwdriver when it is desired to rotate jackscrew 180 to fasten connectors 10,110 together after keying for full mating, and nut 194 is also knurled to enable manual rotation. Jackscrew 180 is dimensioned to be rotatable within hole portions 174,176 of key 160.

Leading end 184 of jackscrew 180 is preferably rounded or tapered at least peripherally therearound. The benefits of such a shape are that leading end 184 is enabled to enter the corresponding threaded aperture 64 of mating key 60 even if jackscrew 180 is slightly angularly misaligned with respect to aperture 64, and jackscrew 180 will be urged slightly into alignment to enable threaded engagement. Since the thinness of the shell members of connector 110 when clinched together provides only minimal engagement of shaft portions of the jackscrews extending through the flange apertures, and therefore the mounting keys secured to the shell flanges by the jackscrews, the shells provide little assurance of precise alignment of the keys and jackscrews to be perpendicular to the shell flanges because of not engaging the shaft portions at two substantially spaced axial locations therealong as is inherent in most electrical connectors either in plastic housings or in surrounding shell members. The present invention provides a means for overcoming the resultant slight angular misalignment of the keys and jackscrews inherently through angular adjustment thereof upon connector mating.

The rearward surfaces 76,170 of the body sections of both key members 60,160 are held against the front surfaces 58,158 of rearward shell members 30,130 respectively after mounting. The forward shell member 28,128 although comprising a thin plate, defines a means for preventing the rotation of the respective key member body section 68,168 after mounting in a selected angular orientation. The pair of thin plates which comprise the flanges of the connector shells 128,130 also define a means in conjunction with the key members 160 of the present invention, for securing jackscrews 180 to connector 110, and also a means for connector 10 to cooperate with the threaded jackscrew forward end of connector 110 to comprise a means for fastening connectors 10,110 together to define mated connector assembly 100. The forward surface of jackscrew nut 194 is disposed closely adjacent to the rearwardly facing surface of rearward shell 130 of connector 110 after roll pin 196 is affixed in a manner permitting jackscrew 180 to remain rotatable after mounting, to stabilize the angular alignment of jackscrew 180 by reason of coextending axially along a substantial length of jackscrew mounting section 188.

In FIG. 1, the keying and mating capabilities of connectors 10,110 is illustrated, wherein the advantages of the present invention can be discerned. The jackscrew leading end 184 is recessed behind the leading end 166 of the keying projection 162 of mounting key 160, and both leading ends are recessed slightly behind the forward end 124 of hood portion 114 of shell member 128. Leading end 184 of jackscrew 180 thus is shaped and positioned not to extend forwardly of leading end 166 of keying projection 162 or forward end end 124 of shell hood portion 114 in a manner which would otherwise render the jackscrew leading end susceptible to being at least laterally stressed upon incidental engagement therewith by foreign objects. Jackscrew 180 thus has a measure of protection from damage during connector handling which otherwise could lead to substantial angular misalignment of the jackscrew or even twisting of flanges 144,146 ultimately preventing fastening and connector mating.

The mounting key member 160 of connector 110 and mating key member 60 of connector 10 are angularly oriented within respective seating apertures 54,154 to cooperate with each other to permit mating since connectors 10,110 are desired to be matable and have been matchingly keyed. As soon as the leading ends 66,166 of the keying projections 62,162 of mating and mounting keys pass by each other due to their matching orientations and facilitated by lead-in surfaces defined by chamfers 82,172, the leading end 184 of jackscrew shank 182 enters threaded bore 64 of mating key 60, facilitated by the rounded or tapered shape of jackscrew leading end 184. Rotation of the jackscrews 180 at both ends of connector 110 begins to draw the connectors together until the connectors 10,110 are fully mated together and their terminals are fully electrically engaged. The very early threaded engagement of jackscrew and opposing threaded key aperture allows very early stabilizing of the connectors during fastening, occurring for example while the forward ends of the contact sections of the terminals are spaced apart about ¼ inch or less.

If any of the key members of one connector were not angularly oriented to correspond with the opposed key member of the other connector, the key members would abut before the jackscrews would begin to enter the opposing threaded key bores and thus prevent fastening; and the connectors and their terminal arrays could not mate. Also, if a jackscrew were to be misaligned during handling, full threaded engagement would be adversely affected or even prevented thus preventing full connector mating even if the connectors were matchingly keyed, a condition which the present invention minimizes.

Connectors 10,110 are adapted to have their keys, jackscrews and mounting accessories easily assembled at the site of an array of a plurality of like connector pairs, and also easily disassembled if desired. This assures that each connector 10,110 in an array of up to thirty-six like connectors 10,110 can be physically coded to be distinct from others of the same array. With each connector 10 being polarized by the D-shaped forward plug section 14 and having two key members 60 of hexagonal shapes, thirty-six coding possibilities exist; if octagonal keys are used, then sixty-four coding possibilities would exist. While each connector 10 may be labeled, the keying system of the present invention provides for mechanical coding to prevent non-matchingly keyed connectors from being mated. With the present invention, a means is provided for securing the keys and jackscrews to the connector shells in a manner permitting the person applying the connectors at the site of in-service use to determine the keying orientations in order to encode the connectors in the context of the connector array being defined at the site. Also, the securing means permits easy disassembly for re-orientation of keys if desired, or replacement of parts if necessary.

The keyed connectors described herein represent the preferred embodiment of the present invention, but it is understood that variations and modifications of the connectors may be made which are within the spirit of the invention and the scope of the claims.

What is claimed is:

1. A keying and fastening system for matable first and second electrical connectors of the type having flanges of the housing means laterally of the terminal arrays where the flanges have a very small axial dimension, comprising key members and jackscrew members secured to housing means of first and second connectors matable together, the system being of the type wherein first key members of the first connector have axially oriented aperture means in body sections thereof within which said jackscrews are rotatable and forwardly from which extend threaded forward jackscrew shanks, and second key members of the second connector are adapted to threadedly receive thereinto the threaded forward jackscrew shanks to fasten together the matchingly keyed connectors after keying and mating thereof, the system comprising:

said first key members each have a keying projections extending forwardly to a leading end;

said second key members each have a keying projection cooperable with a said first key member keying projection, each said second key member keying projection extending forwardly to a leading end and having an aperture means extending thereinto from said leading end, said aperture means being threaded to correspond to said threaded forward shank of a respective said jackscrew for said jackscrew to threadedly engage said second key member during connector fastening upon rotation of said jackscrew; and said first and second keying projection leading ends being chamfered at edges engageable with each other upon the leading ends meeting each other during connector mating, and said jackscrew leading ends being at least tapered peripherally therearound and shaped and positioned with respect to said first key member leading ends in a manner minimizing susceptibility of said jackscrew leading ends to being at least laterally stressed upon incidental engagement therewith by foreign objects, whereby in mating, matchingly keyed connectors the key members relatively adjust their angular alignment for their keying projections to pass by each other during keying, and said jackscrew adjusts its angular alignment to enter the threaded aperture of the respective second key member and begin threaded engagement therewith almost immediately after said leading ends of said keying projections of said first and second key members begin to pass by each other, thereby overcoming possible slight relative angular misalignment of said jackscrews and said key members.

2. A system as set forth in claim 1 wherein said keying projection of each said first key member is shaped as a hood coextending along and radially spaced from said jackscrew forwardly of said body section around about one half of the circumference of said first key member, and said keying projection of said second key member includes a recess axially therealong shaped and dimensioned to receive therealong said keying projection of an associated said first key member upon keying.

3. A system as set forth in claim 1 wherein said body sections of said first and second key members in cross-section define a selected regular polygon and are mountable in respective seating apertures of said connector housing means having shapes corresponding to said regular polygon shape of said body sections to prevent rotation of said body sections therewithin after assembly.

4. A system as set forth in claim 3 wherein said selected regular polygon shape is hexagonal.

5. A system as set forth in claim 1 wherein said housing means of said first connector extends to a forward face farther forward than said leading end of said first key members thereof.

6. A system as set forth in claim 1 wherein each said jackscrew includes a rearward shank end extending rearwardly from a rear surface of the housing means of the first connector, and a nut is placed thereon adapted to be rotated, with a roll pin inserted in interference fit through aligned transverse holes through said nut and said rearward jackscrew end, securing said jackscrew to said first connector housing means and an said associated first key member to said first connector housing means, in a manner permitting rotation of said jackscrew relative to said first connector housing means and said first key member seated in said aperture means of said first connector housing means in a selected keying orientation.

7. A system as set forth in claim 6 wherein said jackscrew rearward shank includes an annular recess to enable a C-shaped locking ring to be snapped therearound after insertion through said first key member and through said flange apertures, prior to assembly of said nut thereon, facilitating assembly.

8. A system as set forth in claim 1 wherein each said second key member includes a threaded rearward portion extending rearwardly from a rearwardly facing surface portion of the housing means of the second connector to receive a nut thereon for securing said second key member to said second connector housing means seated in said forward shell aperture in a manner preventing rotation after assembly.

9. A system as set forth in claim 8 further including a lock washer is assembled between said nut and said rearwardly facing surface portion of said second connector housing means for mounting said second key member tightly to said respective later flange.

10. A system as set forth in claim 1 wherein said jackscrew leading ends are rounded.

11. A system as set forth in claim 1 wherein said jackscrew leading ends are located a selected small distance axially rearwardly from said first key member leading ends.

12. A system as set forth in claim 11 wherein said jackscrew leading ends are rounded.

13. An improved assembly of matable first and second electrical connectors wherein at least the first connector is of the type having forward and rearward metal shells surrounding and retaining therewithin a terminal housing means and exposing a mating face of the housing means for mating with the other connector and a rearward face adapted to provide for electrical connection of the connector terminals with respective conductive means, the forward and rearward shells being securable together and having abutting apertured lateral flanges, the improvement comprising:

at least said first electrical connector being improved by each aperture through said lateral flanges of said forward metal shell having a cross-sectional shape corresponding to a selected regular polygon, and each aperture through said lateral flanges of said rearward metal shell being smaller than and centered with respect to the corresponding said forward metal shell aperture;

a pair of first key members secured along the front surfaces of said lateral flanges of said forward metal shell of said first connector, each said first key member having a body section having a cross-sectional shape corresponding to said selected regular polygon and defining a rear mounting face, and each said first key member further having a keying projection extending forwardly from said body section;

a pair of second key members secured along the front surfaces of lateral flanges of said second connector, each said second key member having a body section having a cross-sectional shape corresponding to said selected regular polygon and defining a rear mounting face, said second key members secured to said lateral flanges within aperture of corresponding cross-sectional shape in a manner to maintain said body sections of said second key members seated within respective said apertures and prevent rotation after assembly, and each said second key member further having a keying projection extending forwardly from said body section;

a pair of jackscrews secured to said first connector at respective said lateral flanges thereof, each said jackscrew having a threaded forward shank portion extending forwardly from a body section to a leading end, each said jackscrew further including a large diameter seating section disposed in a corresponding aperture portion of a respective said first key member body section, and a smaller diameter rearward section extending through a corresponding smaller diameter aperture portion of said respective first key member and rearwardly of a said lateral flange, each said jackscrew mounted to said first connector by means permitting rotation thereof after assembly relative to said first connector and said first key member; and said second key members including threaded apertures extending thereinto from a forward surface thereof adapted to be threadedly engaged by a respective said jackscrew forward shank portions for fastening said connectors together;

at least each said jackscrew leading end being at least tapered to correct the angular alignment of said jackscrew with respect to said second key member aperture and facilitate entry into said threaded aperture of a corresponding said second key member upon initiation of fastening said connectors together.

14. An assembly as set forth in claim 13 wherein each said jackscrew leading end is rounded.

15. An assembly as set forth in claim 13 wherein said leading ends of said keying projections of said first and second key members are chamfered along edges at which said first and second key members initially meet during mating of said first and second connectors, to correct the relative angular alignment of said first and second key members.

* * * * *

UNITED STATES PATENT AND TRADEMARK OFFICE

CERTIFICATE OF CORRECTION

PATENT NO. : 4,929,184

DATED : May 29, 1990

INVENTOR(S) : Atahusain E. Emadi, et al

It is certified that error appears in the above-identified patent and that said Letters Patent is hereby corrected as shown below:

In the Abstract

Line 16 - move phrase "apertures of the key members of the one connector," to before the phrase "with the apertures being slightly larger than the jackscrew portions extending therethrough, the jackscrews being".

In the Claims

Claim 2, Column 10, Line 18 - After the word "of" insert the word --each--.

Signed and Sealed this

Twelfth Day of May, 1992

*Attest:*

DOUGLAS B. COMER

*Attesting Officer*

*Acting Commissioner of Patents and Trademarks*